US006792926B2

(12) United States Patent
Förster et al.

(10) Patent No.: US 6,792,926 B2
(45) Date of Patent: Sep. 21, 2004

(54) IGNITION SYSTEM FOR AN INTERNAL COMBUSTION ENGINE

(75) Inventors: Ralf Förster, Regensburg (DE); Stefan Haimerl, Regensburg (DE); Kurt Kienbaum, Berg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/723,214

(22) Filed: Nov. 26, 2003

(65) Prior Publication Data

US 2004/0123853 A1 Jul. 1, 2004

Related U.S. Application Data

(63) Continuation of application No. PCT/DE02/01959, filed on May 28, 2002.

(30) Foreign Application Priority Data

Jun. 6, 2001 (DE) ..... 101 27 362

(51) Int. Cl.[7] ..... F02P 3/12
(52) U.S. Cl. ..... 123/644; 123/618
(58) Field of Search ..... 123/644, 618, 123/594, 596

(56) References Cited

U.S. PATENT DOCUMENTS 5,399,942 A * 3/1995 Frus ..... 315/209 R
6,615,645 B1 * 9/2003 Butler et al. ..... 73/117.3

FOREIGN PATENT DOCUMENTS

| | | | |
|---|---|---|---|
| DE | 27 34 164 A1 | 2/1978 | ..... F02P/1/08 |
| DE | 28 21 062 A1 | 11/1979 | ..... F02P/3/04 |
| DE | 38 00 932 A1 | 7/1989 | ..... F02P/3/045 |
| DE | 43 31 994 A1 | 3/1995 | ..... F02P/3/05 |
| EP | 0 447 975 A1 | 3/1991 | ..... F02P/3/045 |
| EP | 0 555 851 A2 | 2/1993 | ..... F02P/3/04 |
| EP | 0 566 335 A2 | 4/1993 | ..... F02P/3/05 |
| EP | 0 701 060 A2 | 9/1995 | ..... F02P/17/12 |
| JP | 10026069 | 1/1998 | ..... F02P/3/04 |
| WO | WO 92/17702 | 10/1992 | ..... F02P/3/045 |

OTHER PUBLICATIONS

Copy of 1026069 Japan Patent PTO translation.*

* cited by examiner

*Primary Examiner*—Bibhu Mohanty
(74) *Attorney, Agent, or Firm*—Baker Botts L.L.P.

(57) ABSTRACT

An ignition system (1, 2, 41) for an internal combustion engine is provided with an outlet for electric activation of an ignition element (9) for a combustion element in an internal combustion engine, an energy accumulator (3) for accumulating the electric energy, a control element (4) which is connected to the energy accumulator (3) and which is used to charge the energy accumulator (3) during a predefined charging time, in addition to a measuring unit for detecting the charge state of the energy accumulator (3). In order to set the charge time for the energy accumulator, a timer is provided, said timer being connected to the control element (4) on the outlet side, and the measuring unit (6, 10–12) is connected to said timer in a feedback loop, whereby the timer adjusts the charge time according to the charge state of the measured charge state of the energy accumulator.

14 Claims, 2 Drawing Sheets

IGNITION SYSTEM FOR AN INTERNAL COMBUSTION ENGINE

CROSS REFERENCE TO RELATED APPLICATION

This application is a continuation of copending International Application No. PCT/DE02/01959 filed May 28, 2002, and claiming a priority date of Jun. 6, 2001 which designates the United States.

TECHNICAL FIELD OF THE INVENTION

The invention relates to an ignition system for an internal combustion engine.

BACKGROUND OF THE INVENTION

In the case of non self-ignitable internal combustion engines, the fuel mixture is usually ignited by a spark plug in the combustion chambers of the internal combustion engine by means of which an ignition coil discharges itself.

In this process it is important that a sufficient amount of energy is accumulated in the ignition coil to be able to trigger the ignition spark that requires a correspondingly high electrical current through the ignition coil.

On the other hand, the electrical energy accumulated in the ignition coil should also not be too high because this leads to an increased thermal load of the ignition coil and the ignition output stage and furthermore wear of the spark plug.

Therefore, before each ignition process the electrical energy accumulated in the ignition coil should be within a specified bandwidth to allow the safe triggering of an ignition spark in the case of a minimum thermal load of the ignition coil and the ignition output stage and as little wear as possible of the spark plug.

Therefore, ignition output stages based on Darlington transistors that allow a current limitation are well-known, whereby the energy in the ignition coil is restricted.

However, a disadvantage of such current limiting ignition output stages is the fact that a great amount of heat dissipation is converted because of the current limitation in the ignition output stage.

An ignition system is well-known from DE 43 31 994 A1 in which the ignition output stage is activated via a bidirectional control line in which case the ignition output stage reports back the current value of the ignition coil current via the bidirectional control line. Similar ignition systems are well-known from DE 38 00 932 A1, W092/17702, DE 27 34 164 A1 and DE 28 21 062 A1.

Finally, an ignition system is well-known from EP 0 555 851 A2 in which the ignition output stage measures the ignition voltage and reports back via a separate line.

SUMMARY OF THE INVENTION

Therefore, the object of the invention is based on creating an ignition system for an internal combustion engine that allows a setting of the ignition energy or the ignition current that is as exact as possible without there being a great amount of heat dissipation. In this case, the possibility of a test should be created to determine whether or not the ignition energy was sufficient to trigger an ignition spark with as few connecting lines as possible.

This object can be achieved by an ignition system for an internal combustion engine comprising an output for electrical activation of an ignition element for a combustion chamber in an internal combustion engine, an electrical energy accumulator connected to the output for accumulating the electrical energy required for activating the ignition element, a controllable control element connected to the energy accumulator which is used to charge the energy accumulator during a predefined charge time, a measuring unit for detecting the charge state of the energy accumulator, wherein to set the charge time for the energy accumulator, a timer is provided, said timer being connected to the control element on the output side, and the measuring unit is connected to said timer in a feedback loop whereby the timer adjusts the charge time according to the measured charge state of the energy accumulator, and wherein the measuring unit and the control element, on the one hand, and the timer, on the other hand, are interconnected via a bidirectional control line, wherein the energy accumulator is connected to a voltage measurement unit that monitors the ignition voltage wherein the voltage measurement unit is connected to the control line on the output side via a controllable current source or a controllable current sink to superimpose a current signal on the control line according to the measured voltage.

The measuring unit may have a precision resistor that is connected in series to the energy accumulator. A threshold element can be arranged in the feedback loop between the measuring unit and the timer that compares the measured charge state of the energy accumulator with a predefined threshold value and generates a control signal for the timer according to the comparison. The measuring unit can be connected to the control line via a controllable current sink and/or a controllable current source to superimpose a current signal on the control line for feedback to the timer. The voltage measurement unit may comprise a comparator with two inlets between which the energy accumulator is connected, wherein the comparator activates the controllable current source or the controllable current sink when exceeding a predefined reference voltage value. The energy accumulator can be connected to the comparator via a protective resistor.

The object can also be achieved by a method for controlling the an ignition system for an internal combustion engine comprising the steps of:

- charging an energy accumulator during a predefined charge time to accumulate electrical energy for providing an ignition voltage,
- detecting the charge state of the energy accumulator,
- setting the charge time for the energy accumulator by means of a timer via a bidirectional line, wherein the timer adjusts the charge time according to the measured charge state of the energy accumulator via said bidirectional line,
- measuring the ignition voltage thereby superimposing a current signal on the bidirectional line according to the measured voltage.

The method may further comprise the step of comparing the measured charge state of the energy accumulator with a predefined threshold value and generating a control signal for the timer according to the comparison. The method may further comprise the step of superimposing a current signal on the bidirectional line for feedback to the timer. The current signal can be superimposed when the ignition voltage exceeds a predefined reference voltage value.

The invention includes the general technical theory of adjusting the charge time for the ignition coil instead of limiting the current, in which case the charge time is adjusted according to the electrical current at the end of the charge time.

Therefore, the ignition system according to the invention has a timer that sets the duration of the charge time and, therefore, the energy content of the ignition coil before the next ignition process.

The ignition system according to the invention also has a measuring unit for detecting the charge state of the energy accumulator in which case the measuring unit is connected to said timer in a feedback loop to adjust the charge time according to the charge state that is set at the end of the charge time.

If the energy content at the end of the charge time is too low to trigger an ignition spark, the charge time is adjusted upwards by the feedback loop so that the energy content of the ignition coil is increased during the next charge process. For this, the switch-on time of the control element connected to the ignition coil is tilted forwards, whereas the switch-off time and, with that the end of the charge process are retained because this time is predefined by the time of ignition according to the specific crankshaft setting.

However, if the measuring unit detects that the energy content of the ignition coil at the end of the charge time is higher than necessary, the charge time is adjusted downwards by the feedback loop while the switch-on time of the control element connected to the energy accumulator is shifted backwards in which case the charge time is reduced. However, the switch-off time and thereby the end of the charge time are retained in this case since this time is specified by the predefined ignition point.

The measuring unit preferably has a precision resistor for measuring the charge state that is connected in series to the energy accumulator or the ignition coil so that the electrical voltage dropping via the precision resistor allows the energy content of the ignition coil to be determined.

A threshold element is preferably arranged in the feedback loop between the measuring unit and the timer that compares the measured charge state of the energy accumulator with a predefined threshold value and generates a control signal for the timer according to the comparison. Therefore, in this embodiment only one digital signal is transferred via the feedback loop that indicates whether or not the charge time is too long or too short.

In the preferred embodiment of the invention the data is transmitted via a bidirectional control line between the timer and the measuring unit, on the one hand, and the controllable control element, on the other hand. The data is preferably transmitted here from the measuring unit to the timer in such a way that the measuring unit activates a controllable current sink or a controllable current source to superimpose a current signal on the bidirectional control line for feedback to the timer.

A voltmeter is also connected to the energy accumulator that monitors the ignition voltage in which case the voltmeter is connected to the bidirectional control line on the output side via a controllable current source or a controllable current sink to superimpose a current signal on the control line according to the measured voltage. In this way, information about the duration of the ignition spark can be transferred to the timer.

BRIEF DESCRIPTION OF THE DRAWINGS

Other advantageous further developments are explained below together with the description of the preferred embodiments on the basis of the accompanying figures. They are as follows.

DETAILED DESCRIPTION OF THE PREFERRED EMBODIMENTS

Figure 1:
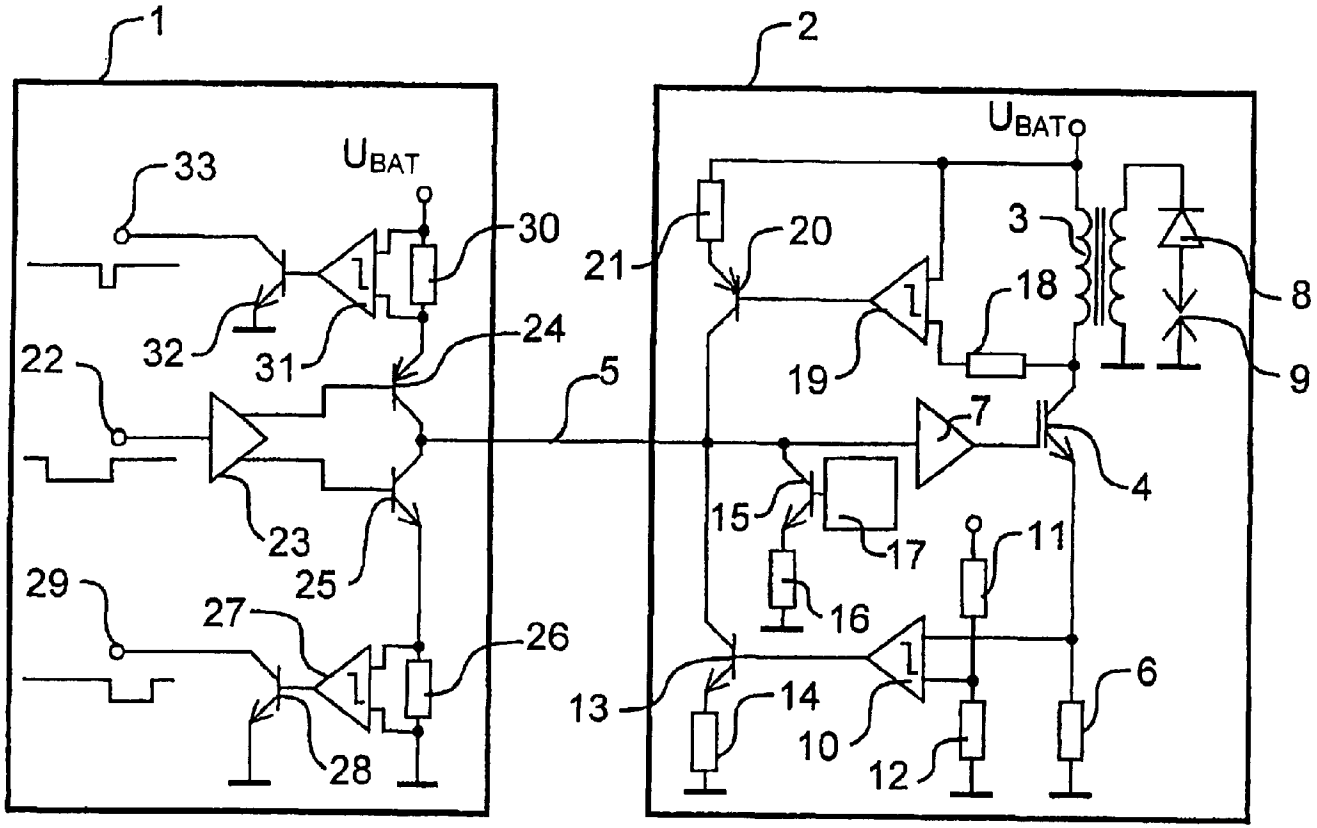
FIG. 1 an ignition system according to the invention.

The ignition system shown in FIG. 1 consists of a control unit 1 and an ignition device 2 with an integrated ignition coil 3 and a likewise integrated ignition output stage 4 in which case the control unit 1 is connected to the ignition device 2 via a bidirectional control line 5.

The control line 5, on the one hand, controls the charge process of the ignition coil 3 and, on the other hand, allows feedback from the ignition device 2 to the control unit 1 about the charge state of the ignition coil 3 and the spark burning period as explained in greater detail below.

The structural setup of the ignition device 2 and the control unit 1 is first of all described below so that their functionality can subsequently be described in detail.

The ignition coil 3 is connected in series to the ignition output stage 4 consisting of an IGBT and a precision resistor 6 between the battery voltage $U_{BAT}$ and ground so that the ignition coil 3 forms an RL element with the precision resistor 6 when connecting through the ignition output stage 4.

Figure 2:
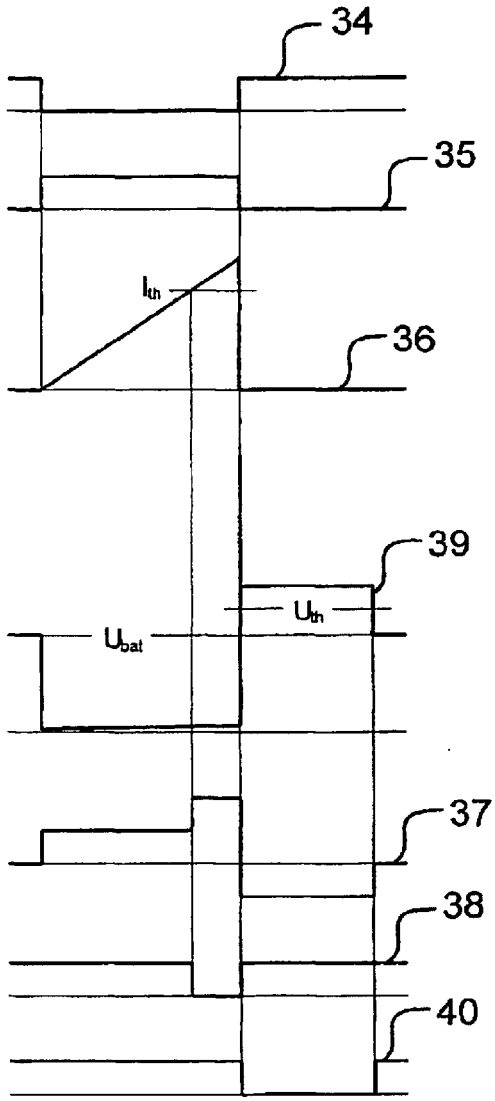
FIG. 2 pulse diagrams for explaining the data transmission between the control unit and the ignition device.

The gate of the ignition output stage 4 is connected to the control inlet of ignition device 2 via a driver 7 through which the ignition device 2 is connected to the control unit 1 via the bidirectional control line 5. Therefore, the control unit 1 can connect through the ignition output stage 4 via the bidirectional control line 5 whereupon the electrical current rises linearly to a large extent through the ignition coil 3 as shown in FIG. 2.

The ignition coil 3 is connected to a spark plug 9 via a diode 8 on the output side so that the ignition coil 3 can discharge itself via the spark plug 9 when blocking the ignition output stage 4, in which case an ignition spark is generated.

Between the ignition output stage 4 and the precision resistor 6 there is a tapping point for voltage metering that is connected to a measuring inlet of a comparator 10. The other inlet of the comparator is connected to the central tapping point of a voltage divider that consists of two resistors 11, 12 in which case the size of resistor 12 defines a reference current value for charging the ignition coil 3.

Comparator 10 is connected on the output side to the basis of a transistor 13 that connects the control inlet of the ignition device to ground via a resistor 14 and forms a controllable current sink. When connecting through the transistor 13, the control inlet of the ignition device 2 is grounded, namely, via the resistor 14 so that the ignition device 2 draws an additional current through the bidirectional connecting line from the control unit that is detected by it. The transistor 13 is then connected through if the comparator 10 identifies that the electrical current flowing through the ignition coil 3 exceeds the predefined reference current value.

The ignition device 2 also has a further controllable current sink that consists of a transistor 15 and a resistor 16 connected to ground in which case the transistor 15 is only activated by a diagnostic circuit 17 shown in the diagram.

The ignition device 2 also makes possible the transfer of the spark burning period. For this, the connection on the ground side of the ignition coil 3 is connected to an inlet of a comparator 19 via a resistor 18 in which case the other inlet of comparator 19 is connected to the battery voltage $U_{BAT}$. Therefore, the comparator 19 compares the electrical voltage dropping via the ignition coil 3 with a predefined reference voltage value to be able to determine whether or not an ignition spark is given off.

On the output side the comparator is compared with a controllable current source that consists of a transistor 20 and a resistor 21 in which case the transistor 20 connects the control inlet of the ignition device 2 to the battery voltage $U_{BAT}$ when connecting through via the resistor 21 so that the current source drives a current through the bidirectional control line that reduces the electrical current drawn from the ignition device 2 through the bidirectional control line from control unit 1 as shown in FIG. 2.

The structural setup of the control unit 1 is described below.

In order to introduce the charge process for the ignition coil 3, the control unit has a connection 22 that can, for example, be activated by a microprocessor that is not shown in which case the microprocessor serves as a timer and predefines the charge time for the ignition coil 3. The connection 22 is low active and connected to the basis of two transistors 24, 25 via a driver 23, in which case the driver 23 adjusts the level between the bidirectional control line 5 and the connection 22 for connection to a microprocessor.

In the case of a logical low level at connection 22, the transistor 24 connects through whereas the transistor 25 connects through in the case of a logical high level.

In this case, the transistor 25 is connected on the ground side to ground via a precision resistor 26 and in the framework of the ignition diagnosis determines the spark burning period transferred from the ignition device 2 via the bidirectional control line 5. In addition to this, the precision resistor 26 is connected to the two inlets of a comparator 27 that consequently compares the current flowing through the precision resistor 26 with a predefined reference value.

The comparator 27 is connected on the output side to the basis of a transistor 28 that is grounded when connecting through a connection 28. Therefore, the digital signal at the connection 29 again reproduces the current through the precision resistor and is on low during the spark burning period.

The transistor 24 is connected to the battery voltage $U_{BAT}$ via a precision resistor 30 in which case the precision resistor 30 is again connected to the two inlets of a comparator 31 that consequently compares the electrical current flowing through the precision resistor 30 with a predefined reference value.

The comparator 31 is connected on the output side to the basis of a transistor 32 that is grounded when connecting through a connection 33 so that the connection 33 accepts a low level if the current flowing through the precision resistor 30 exceeds the predefined reference value.

The functioning of the arrangement described above is explained below with reference to the signal patterns shown in FIG. 2.

At connection 22 of control unit 1, there is a signal 34 that is generated by a microprocessor that is not shown in which case the signal 34 during the low phase connects through the transistor 24 and during the high phase connects through the transistor 25 so that the bidirectional control line 5 accepts a predefined signal pattern 35 with a specific electrical potential.

Connecting through the transistor 24 again leads to the fact that the ignition output stage 4 connects through in the ignition device 2 so that an approximately linear rise in current flows with a predefined signal pattern 36 through the series connection from the ignition coil 3, the ignition output stage 4 and the precision resistor 6. The linearity of the current pattern 36 follows from the fact that the inductivity of the ignition coil 3 is not constant.

The rise of the electrical current through the ignition coil 3 and the precision resistor 6 leads to an increasing voltage difference at the inlets of the comparator so that the comparator 10 connects through the transistor 13 if the current through the ignition coil 3 reaches a predefined threshold value $I_{th}$. Connecting through the transistor 13 then leads to the fact that the bidirectional control line 5 in the ignition device 2 is grounded via the resistor 14 so that a greater amount of current flows through the bidirectional control line 5 as can be seen from the signal pattern 37. The greater amount of current flowing through the precision resistor 30 and the bidirectional control line 5 leads to the fact that the comparator 31 connects through the transistor 32 so that the connection 33 is grounded as shown on the basis of the signal pattern 38.

The low phase of the signal pattern 38 is evaluated by the counter in the microprocessor that is not shown. After the expiry of a predefined period, the microprocessor serving as a timer again sets the connection 22 to logical high so that the transistor 24 blocks and the transistor 25 connects through in which case the electrical potential on the bidirectional control line is drawn to logical low as can be seen in the signal pattern 35. Blocking the transistor 24 also leads to blocking the ignition output stage 4 whereupon the current suddenly breaks in through the ignition coil 3 as can be taken from the signal pattern 36.

Because the current flowing through the ignition coil 3 cannot change suddenly on the basis of the inductivity of the ignition coil 3, the ignition coil 3 discharges itself via the spark plug 9 so that an ignition spark is given off. Here a voltage is induced on the primary side in the ignition coil 3 as can be seen in the signal pattern 39. The induction of the voltage on the primary side in the ignition coil during the ignition process leads to the fact that the comparator 19 connects through the transistor 20 of the controllable current source so that the ignition device 2 drives a current through the bidirectional control line 5 in the direction of the control unit 1 as can be seen on the basis of the signal pattern 37. Therefore, during the ignition process, the polarity of the current flowing through the bidirectional control line 5 changes. The current driven from the ignition device in this way flows through the transistor 25 and the precision resistor 26 to ground so that the comparator 27 connects through the transistor 28 whereupon the connection 29 is grounded as can be seen in the signal pattern 40. Therefore, the low level at the connection 29 signals the duration of the ignition spark. In this way, the microprocessor connected to the connection 29 that is not shown can identify whether or not the electrical energy accumulated in the ignition coil 3 before the actual ignition process was sufficient to trigger an ignition spark.

The microprocessor connected to the connections 22, 29 and 33 in this case adjusts the switch-on time for the ignition output stage 4 according to the feedback about the charge state.

The invention is not restricted to the embodiment described above. On the contrary, a plurality of variants and modifications that also make use of the inventive idea and fall within its scope of protection can be envisaged.

We claim:

1. An ignition system for an internal combustion engine comprising:

an output for electrical activation of an ignition element for a combustion chamber in an internal combustion engine, an electrical energy accumulator connected to the output for accumulating the electrical energy required for activating the ignition element, a controllable control element connected to the energy accumulator which is used to charge the energy accumulator during a predefined charge time, a measuring unit for detecting the charge state of the energy accumulator, wherein to set the charge time for the energy accumulator, a timer is provided, said timer being connected to the control element on the output side, wherein the measuring unit is connected to said timer in a feedback loop whereby the timer adjusts the charge time according to the measured charge state of the energy accumulator, and wherein the measuring unit and the control element, on the one hand, and the timer, on the other hand, are interconnected via a bidirectional control line, and wherein the energy accumulator is connected to a voltage measurement unit that monitors the ignition voltage wherein the voltage measurement unit is connected to the control line on the output side via a controllable current source or a controllable current sink to superimpose a current signal on the control line according to the measured voltage.

2. The ignition system according to claim 1, wherein the measuring unit has a precision resistor that is connected in series to the energy accumulator.

3. The ignition system according to claim 2, wherein a threshold element is arranged in the feedback loop between the measuring unit and the timer that compares the measured charge state of the energy accumulator with a predefined threshold value and generates a control signal for the timer according to the comparison.

4. The ignition system according to claim 1, wherein the measuring unit is connected to the control line via a controllable current sink and/or a controllable current source to superimpose a current signal on the control line for feedback to the timer.

5. The ignition system according to claim 1, wherein the voltage measurement unit comprises a comparator with two inlets between which the energy accumulator is connected, wherein the comparator activates the controllable current source or the controllable current sink when exceeding a predefined reference voltage value.

6. The ignition system according to claim 5, wherein the energy accumulator is connected to the comparator via a protective resistor.

7. A method for controlling the an ignition system for an internal combustion engine comprising the steps of:

charging an energy accumulator during a predefined charge time to accumulate electrical energy for providing an ignition voltage, detecting the charge state of the energy accumulator, setting the charge time for the energy accumulator by means of a timer via a bidirectional line, wherein the timer adjusts the charge time according to the measured charge state of the energy accumulator via said bidirectional line, and measuring the ignition voltage thereby superimposing a current signal on the bidirectional line according to the measured voltage.

8. The method according to claim 7, further comprising the step of comparing the measured charge state of the energy accumulator with a predefined threshold value and generating a control signal for the timer according to the comparison.

9. The method according to claim 7, further comprising the step of superimposing a current signal on the bidirectional line for feedback to the timer.

10. The method according to claim 7, wherein the current signal is superimposed when the ignition voltage exceeds a predefined reference voltage value.

11. An ignition system for an internal combustion engine comprising:

an output for electrical activation of an ignition element for a combustion chamber in an internal combustion engine, an electrical energy accumulator connected to the output for accumulating the electrical energy required for activating the ignition element, a controllable control element connected to the energy accumulator which is used to charge the energy accumulator during a predefined charge time, a measuring unit for detecting the charge state of the energy accumulator, wherein to set the charge time for the energy accumulator, a timer is provided, said timer being connected to the control element on the output side, wherein the measuring unit is connected to said timer in a feedback loop whereby the timer adjusts the charge time according to the measured charge state of the energy accumulator, and wherein the measuring unit and the control element, on the one hand, and the timer, on the other hand, are interconnected via a bidirectional control line, wherein the energy accumulator is connected to a voltage measurement unit that monitors the ignition voltage wherein the voltage measurement unit is connected to the control line on the output side via a controllable current source or a controllable current sink to superimpose a current signal on the control line according to the measured voltage, wherein the measuring unit comprises a precision resistor that is connected in series to the energy accumulator, and wherein a threshold element is arranged in the feedback loop between the measuring unit and the timer that compares the measured charge state of the energy accumulator with a predefined threshold value and generates a control signal for the timer according to the comparison.

12. The ignition system according to claim 11, wherein the measuring unit is connected to the control line via a controllable current sink and/or a controllable current source to superimpose a current signal on the control line for feedback to the timer.

13. The ignition system according to claim 11, wherein the voltage measurement unit comprises a comparator with two inlets between which the energy accumulator is connected, wherein the comparator activates the controllable current source or the controllable current sink when exceeding a predefined reference voltage value.

14. The ignition system according to claim 13, wherein the energy accumulator is connected to the comparator via a protective resistor.

* * * * *